US009060235B2

(12) United States Patent
Yanz et al.

(10) Patent No.: US 9,060,235 B2
(45) Date of Patent: Jun. 16, 2015

(54) PROGRAMMABLE INTERFACE FOR FITTING HEARING DEVICES

(75) Inventors: Jerry L. Yanz, North Oaks, MN (US); Blane A. Anderson, Burnsville, MN (US); Michael J. John, Champlin, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 529 days.

(21) Appl. No.: 13/540,346

(22) Filed: Jul. 2, 2012

(65) Prior Publication Data

US 2012/0269369 A1 Oct. 25, 2012

Related U.S. Application Data

(60) Continuation of application No. 12/098,869, filed on Apr. 7, 2008, now abandoned, which is a division of application No. 10/269,524, filed on Oct. 11, 2002, now Pat. No. 7,366,307.

(51) Int. Cl.
*H04R 29/00* (2006.01)
*H04R 25/00* (2006.01)

(52) U.S. Cl.
CPC ..... *H04R 25/70* (2013.01)

(58) Field of Classification Search
CPC ..... H04R 25/70; H04R 25/00; G10L 2021/0135; G10L 2021/065; G10L 21/003; G10L 21/0205; G10L 21/0364; G10L 21/057
USPC ..... 381/60, 58, 59, 312, 321, 314, 315, 381/119, 98; 600/559; 700/94; 345/648
See application file for complete search history.

(56) References Cited

U.S. PATENT DOCUMENTS

| | | | | |
|---|---|---|---|---|
| 5,083,312 | A | 1/1992 | Newton et al. | |
| 5,511,157 | A | 4/1996 | Wang | |
| 5,626,629 | A * | 5/1997 | Faltys et al. | 607/57 |
| 5,751,285 | A | 5/1998 | Kashiwagi et al. | |
| 5,802,185 | A | 9/1998 | Hansen | |
| 5,812,688 | A * | 9/1998 | Gibson | 381/119 |
| 5,832,097 | A | 11/1998 | Armstrong et al. | |
| 5,835,611 | A * | 11/1998 | Kaiser et al. | 381/321 |
| 6,097,824 | A | 8/2000 | Lindemann et al. | |
| 6,201,875 | B1 | 3/2001 | Davis et al. | |
| 6,411,289 | B1 | 6/2002 | Zimmerman | |
| 6,449,372 | B1 * | 9/2002 | Greminger | 381/314 |
| 6,574,342 | B1 | 6/2003 | Davis et al. | |
| 6,606,391 | B2 | 8/2003 | Brennan et al. | |
| 6,901,560 | B1 | 5/2005 | Guerlain et al. | |

(Continued)

FOREIGN PATENT DOCUMENTS

| | | |
|---|---|---|
| EP | 0794687 A1 | 9/1997 |
| EP | 0537026 B1 | 12/1999 |

OTHER PUBLICATIONS

U.S. Appl. No. 10/269,524, Advisory Action mailed Jul. 11, 2007, 4 pgs.

(Continued)

*Primary Examiner* — Lun-See Lao
(74) *Attorney, Agent, or Firm* — Schwegman Lundberg & Woessner, P.A.

(57) ABSTRACT

A graphical interface is provided to select parameters for fitting a hearing device. The graphical interface provides a mechanism to visually represent and control values of these parameters.

20 Claims, 7 Drawing Sheets

(56) References Cited

U.S. PATENT DOCUMENTS

| | | | | |
|---|---|---|---|---|
| 7,054,449 | B2 * | 5/2006 | Ludi | 381/60 |
| 7,366,307 | B2 | 4/2008 | Yanz et al. | |
| 7,672,468 | B2 | 3/2010 | Kaiser et al. | |
| 8,107,655 | B1 | 1/2012 | Howes et al. | |
| 8,644,537 | B1 | 2/2014 | Howes et al. | |
| 2003/0086579 | A1 | 5/2003 | Lashina et al. | |
| 2004/0071304 | A1 | 4/2004 | Yanz et al. | |
| 2006/0098831 | A1 | 5/2006 | Kaiser et al. | |
| 2008/0187146 | A1 | 8/2008 | Yanz et al. | |

OTHER PUBLICATIONS

U.S. Appl. No. 10/269,524, Decision mailed Sep. 19, 2007 on Pre-Appeal Brief filed Aug. 2, 2007, 2 pgs.
U.S. Appl. No. 10/269,524, Examiner Interview Summary mailed Oct. 16, 2007, 2 pgs.
U.S. Appl. No. 10/269,524, Final Office Action mailed May 2, 2007, 17 pgs.
U.S. Appl. No. 10/269,524, Non Final Office Action mailed Sep. 16, 2006, 17 pgs.
U.S. Appl. No. 10/269,524, Notice of Allowance mailed Dec. 13, 2007, NOAR, 8 pgs.
U.S. Appl. No. 10/269,524, Pre-Appeal Brief filed Aug. 2, 2007, 5 pgs.
U.S. Appl. No. 10/269,524, Response filed Jan. 19, 2007 to Non Final Office Action mailed Sep. 16, 2006, 19 pgs.
U.S. Appl. No. 10/269,524, Response filed Jul. 2, 2007 to Final Office Action mailed May 2, 2007, 17 pgs.
U.S. Appl. No. 10/269,524, Response filed Jul. 12, 2006 to Restriction Requirement mailed Jun. 12, 2006, 17 pgs.
U.S. Appl. No. 10/269,524, Restriction Requirement mailed Jun. 12, 2006, 6 pgs.
U.S. Appl. No. 10/269,524, Supplemental Amendment mailed Oct. 5, 2007, 15 pgs.
U.S. Appl. No. 11/625,736, Non Final Office Action mailed Apr. 14, 2011, 8 pgs.
U.S. Appl. No. 11/625,736, Notice of Allowance mailed Sep. 29, 2011, 5 pgs.
U.S. Appl. No. 11/625,736, Response filed Feb. 24, 2011 to Restriction Requirement mailed Feb. 18, 2011, 7 pgs.
U.S. Appl. No. 11/625,736, Response filed Jul. 14, 2011 to Non-Final Office Action mailed Apr. 14, 2011, 10 pgs.
U.S. Appl. No. 11/625,736, Restriction Requirement mailed Feb. 18, 2011, 6 pgs.
U.S. Appl. No. 12/098,869 Restriction Requirement mailed Oct. 14, 2010, 6 pgs.
U.S. Appl. No. 12/098,869 , Response filed Dec. 1, 2011 to Final Office Action mailed Sep. 1, 2011, 11 pgs.
U.S. Appl. No. 12/098,869, Advisory Action mailed Dec. 14, 2011, 4 pgs.
U.S. Appl. No. 12/098,869, Examiner Interview Summary mailed Dec. 14, 2011, 3 pgs.
U.S. Appl. No. 12/098,869, Final Office Action mailed Sep. 1, 2011, 16 pgs.
U.S. Appl. No. 12/098,869, Non Final Office Action mailed Jan. 20, 2011, 13 pgs.
U.S. Appl. No. 12/098,869, Notice of Appeal filed Feb. 1, 2012, 1 pg.
U.S. Appl. No. 12/098,869, Response filed Jun. 20, 2011 to Non-Final Office Action mailed Jan. 20, 2011, 9 pgs.
U.S. Appl. No. 12/098,869, Response filed Nov. 15, 2010 to Restriction Requirement mailed Oct. 14, 2010, 8 pgs.
U.S. Appl. No. 13/340,092, Response filed Jun. 17, 2013 to Non Final Office Action mailed Mar. 15, 2013, 7 pgs.
U.S. Appl. No. 13/340,092, Non Final Office Action mailed Mar. 15, 2013, 6 pgs.
U.S. Appl. No. 13/340,092, Notice of Allowance mailed Sep. 26, 2013, 6 pgs.
Clancy, David A, "Highlighting developments in hearing aids: Advancements in technology, amplification guide industry into the future", Hearing Instruments, (Dec. 1995), 2 pgs.

* cited by examiner

PROGRAMMABLE INTERFACE FOR FITTING HEARING DEVICES

RELATED APPLICATIONS

This application is a continuation of and claims the benefit of priority under 35 U.S.C. §120 to U.S. patent application Ser. No. 12/098,869, filed Apr. 7, 2008, which is a divisional of and claims the benefit of priority under 35 U.S.C. §120 to U.S. patent application Ser. No. 10/269,524 filed Oct. 11, 2002 (now U.S. Pat. No. 7,366,307), the benefit of priority of each of which is claimed hereby, and each of which are incorporated by reference herein in its entirety.

FIELD OF THE INVENTION

The invention relates to programming hearing devices. Specifically, the invention relates to graphical interfaces in computer systems to select parameters for fitting hearing devices.

BACKGROUND OF THE INVENTION

Over the years, hearing devices to assist the hearing impaired have advanced in design and functionality. Today's hearing devices are electronic devices with sophisticated circuitry providing signal processing functions which can include noise reduction, amplification, and tone control. In many hearing devices these and other functions can be programmably varied to fit the requirements of individual users.

Hearing devices, including hearing aids for use in the ear, in the ear canal, and behind the ear, have been developed to ameliorate the effects of hearing losses in individuals. Hearing deficiencies can range from deafness to hearing losses where the individual has impairment responding to different frequencies of sound or to being able to differentiate sounds occurring simultaneously. The hearing device in its most elementary form usually provides for auditory correction through the amplification and filtering of sound provided in the environment with the intent that the individual hears better than without the amplification.

It is common that an individual's hearing loss is not uniform over the entire frequency spectrum of audible sound. An individual's hearing loss may be greater at higher frequency ranges than at lower frequencies. Recognizing these differentiations in hearing loss considerations between individuals, hearing health professionals typically make measurements that will indicate the type of correction or assistance that will be the most beneficial to improve that individual's hearing capability. A variety of measurements may be taken to determine the extent of an individual's hearing impairment. With these measurements, programmable parameters for fitting a hearing are determined. These parameters are selected using a system typically having graphical interfaces for viewing and setting the parameters. With modern hearing devices having a multitude of parameters such as multiple channels with different gains over different frequencies, a large number of parameters need to be adjusted to properly fit a hearing device to an individual.

What is needed is a visual presentation of these parameters and a straightforward means for selecting the appropriate parameters for programming a hearing device to improve its performance.

For these and other reasons there is a need for the present invention.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the spirit and scope of the present invention. The following detailed description is, therefore, not to be taken in a limiting sense, and the scope of the present invention is defined by the appended claims and their equivalents.

A graphical interface and method for providing the graphical interface are provided to select parameters for fitting a hearing device. The graphical interface provides means for visually representing and controlling values of these parameters using a common reference axis for multiple parameters related by a programmable constraint. The common reference multiple parameter structures convey information to a user about the interactions between parameters and the limits of the parameters. Further, parameters related by a constraint relation are displayed on graphical structures having a common path, such that movement of a slider representing a parameter can be limited within the bounds of the programmed constraints. Such limited movement is visually conveyed to the user allowing the user to make appropriate adjustment using the graphical interface to remain within the limits of the constraint while programming a hearing device for improving performance.

In an embodiment, a method for fitting a hearing device includes adjusting a plurality of sliders on a display, where each slider represents a different parameter for fitting the hearing device. The plurality of sliders are referenced to a common path. Subsequently, signals are output to the hearing device. The signals are correlated to the parameters represented by the sliders. Significantly, adjusting the plurality of sliders is limited by constraints between the parameters. The adjustment of the sliders is accomplished on a graphical interface displayed on a monitor of a system that includes a computer and a selection device.

System

Figure 1:
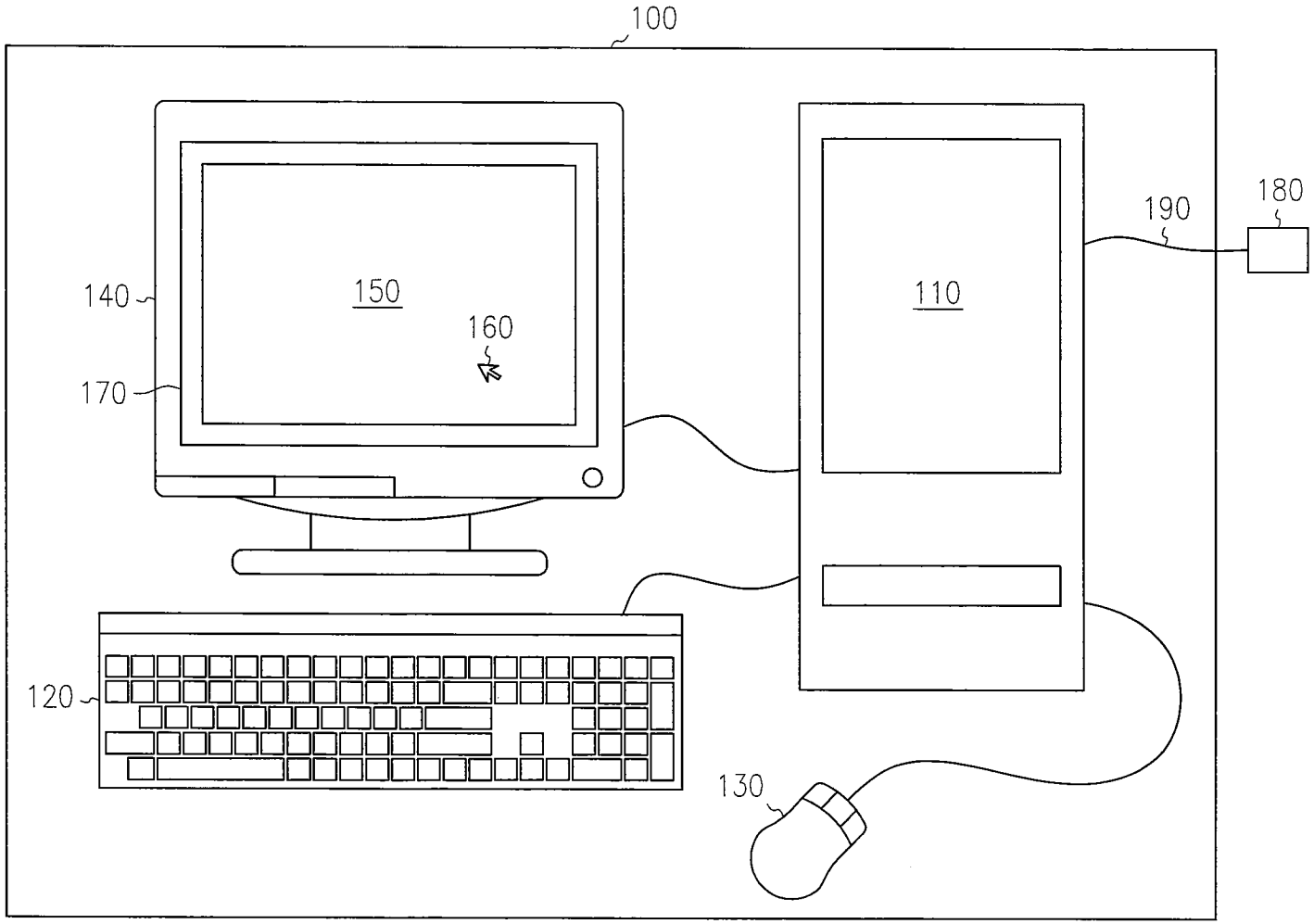
FIG. 1 shows an embodiment of a system for fitting a hearing device, in accordance with the teachings of the present invention.

FIG. 1 shows an embodiment of a system 100 for fitting a hearing device, in accordance with the teachings of the present invention. The system includes a computer 110 coupled to a keyboard 120 and a mouse 130 to receive inputs from system users. System 100 also includes a monitor 140 coupled to computer 110 that provides a screen display 150 under the control of a program for providing information to a user and for interacting with the user. The movement of the mouse 130 is correlated to the movement of a pointer 160 on monitor display 170. The keys of the keyboard 120 can also be used to operate pointer 160 on monitor display 170. The computer is coupled to a hearing device 180 by a medium 190 for transmitting to and receiving from hearing device 180 parameters or information related to parameters for fitting hearing device 180.

In various embodiments, computer 110 includes a personal computer in the form of a desk top computer, a laptop computer, a notebook computer, a hand-held computer device having a display screen, or any other computing device under the control of a program that has a display and a selection device for moving a pointer on the display. Further, computer 110 includes any processor capable of executing instructions for selecting parameters to fit a hearing device using a graphical interface as screen display 150.

In various embodiments, monitor 140 includes a standalone monitor used with a personal computer, a display for a laptop computer, or a screen display for a hand-held computer. Further, monitor 140 includes any display device capable of displaying a graphic interface used in conjunction with a selection device to move objects on the screen of the display device.

In an embodiment, mouse 130 controls pointer 160 in a traditional "drag and drop" manner. Moving mouse 130 can direct pointer 160 to a specific location on monitor display 170. Mouse 130 can select an object at the specific location by actuating or "clicking" one or more buttons on the mouse. Then, the object can be moved to another location on monitor display 170 by moving or "dragging" the object with pointer 160 to the other location by moving mouse 130. Traditionally, to move the screen object the actuated button is held in the "click" position until pointer 160 reaches the desired location. Releasing the mouse button "drops" the object at the screen location of pointer 160. Additionally, with the cursor placed at one extreme of the slider path, clicking the mouse at that position moves the slider in the direction of the cursor. Alternately, an object could be moved by clicking the mouse with pointer 160 on the object, moving pointer 160 to the desired location on the monitor screen 170 and clicking another button of mouse 130. In other embodiments, other selection devices are used to move objects on screen display 150. In one embodiment, keyboard 120 is used as a selection device to control pointer 160. In another embodiment, a stylus, as used with hand-held display devices, is used to control pointer 160.

Screen display 150 is a graphical interface operating in response to a program that allows a user to interact with computer 110 using pointer 160 under the control of a selection device such as mouse 130 and/or keyboard 120 in a point and click fashion. In one embodiment, the selection device is wirelessly coupled to computer 110. In one embodiment, a series of screen displays or graphical interfaces are employed to facilitate the fitting of hearing device 180. The screen display 150 provides information regarding adjustable parameters of hearing device 180. Data to provide this information is input to the computer through user input from the keyboard, from a computer readable medium such as a diskette or a compact disc, from a database not contained within the computer via wired or wireless connections, and from hearing device 180 via medium 190. Medium 190 is a wired or wireless medium.

Medium 190 is also used to program hearing device 180 with parameters for fitting hearing device 180 in response to user interaction with the screen displays to determine the optimum values for these parameters. In one embodiment, medium 190 is a wireless communication medium that includes, but is not limited to, inductance, infrared, and RF transmissions. In other embodiments, medium 190 is a transmission medium that interfaces to computer 110 and hearing device 180 using a standard type of interface such as PCMCIA, USB, RS-232, SCSI, or IEEE 1394 (Firewire). In various embodiments using these interfaces, hearing device 180 includes a hearing aid and a peripheral unit removably coupled to the hearing aid for receiving the parameters from computer 110 to provide programming signals to the hearing aid. In another embodiment, a hearing aid is configured to receive signals directly from computer 110.

In one embodiment, system 100 is configured for fitting hearing device 180 using one or more embodiments of graphical interfaces that are provided in the descriptions that follow. Further, computer 110 is programmed to execute instructions that provide for the use of these graphical interfaces for fitting hearing device 180.

A First Graphical Interface

Figure 2:
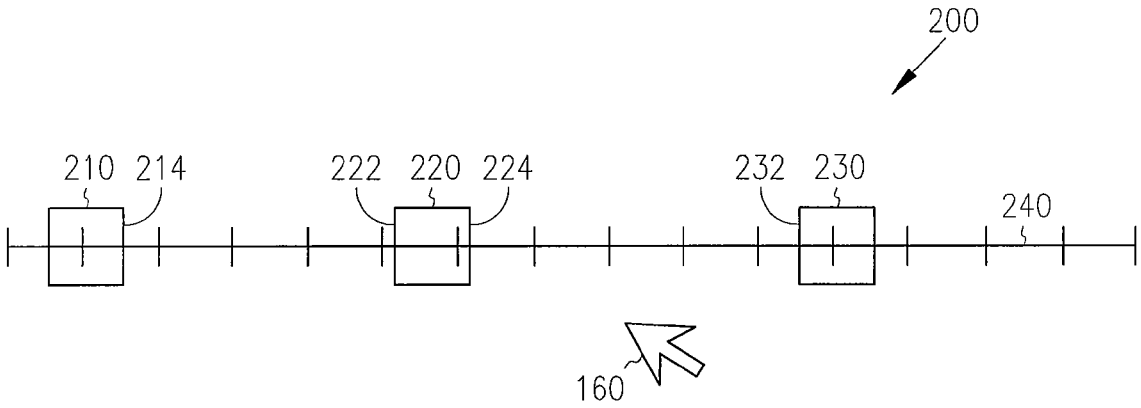
FIG. 2 shows an embodiment of elements of a graphical interface displaying multiple parameters, in accordance with the teachings of the present invention.

FIG. 2 shows an embodiment of elements of a graphical interface 200 for displaying multiple parameters, in accordance with the teachings of the present invention. Graphical interface 200 is displayed in system 100 of FIG. 1 and includes three sliders 210, 220, 230 arranged along a common path 240. The common path 240 can be a line, a scaled line, an axis, a scaled axis, or a curvilinear path.

Each slider 210, 220, 230 represents a parameter of a system, where each parameter has a common feature that varies in value from parameter to parameter, and hence from slider to slider. Moving the sliders is accomplished in a "drag and drop" manner by selecting a slider with pointer 160 and moving pointer 160, dragging the selected slider, along common path 240. Each slider 210, 220, 230 is movable. However, the sliders 210, 220, 230 are limited to moving between the boundaries of the other sliders. Though each slider is related to a different parameter, the parameters are related to each other such that there is no overlap of the boundaries. Thus, graphical interface 200 would only show slider 210 moved to the right along path 240 with boundary 214 touching boundary 222 of slider 220. Likewise, boundary 232 of slider 230 will only be displayed to the left along common path 240 touching boundary 224 of slider 220.

Each slider 210, 220, 230 represents a different parameter having a possible range of values. However, the range of values can be different for each parameter. The sliders 210, 220, 230 can have different sizes in graphical interface 200 to reflect the different ranges of parameter values. Though each slider 210, 220, 230 is shown as a rectangular box, these sliders can be displayed having any shape including but not limited to circles, triangles, and any form of polygon. Further, graphical interface 200 is not limited to using three sliders, but can include as many sliders as required to represent parameters of a system having a common feature for which there is a non-overlapping range of values between parameters.

In one embodiment, graphical interface 200 provides a user interface for fitting a hearing device 180. Hearing device 180 is a four-channel instrument having three cross-over frequencies: one cross-over frequency between channel one and channel two, one cross-over frequency between channel two and channel three, and one cross-over frequency between channel three and channel four. A traditional representation of the four-channel instrument would use three sliders representing three cross-over frequencies, each on a separate axis. Consequently, a user would have to adjust each slider separately to control an overlap of frequency ranges associated with three slider axes.

In an embodiment of FIG. 2, sliders 210, 220, 230 represent cross-over frequencies having a range of possible frequencies along the common path 240. Slider 210 represents a cross-over frequency of 500 Hz in a range from 250 Hz to 1,500 Hz. Slider 220 represents a cross-over frequency of 1,650 HZ in a range from 750 Hz to 2,500 Hz. Slider 230 represents a cross-over frequency of 3,000 Hz in a range from 1,600 Hz to 4,000 Hz. Though each cross-over frequency has an allowable range which may over overlap an allowable range for another cross-frequency, these cross-over frequencies are constrained for the fitting of a hearing device.

One constraint requires the cross-over frequencies not overlap. For instance, the channel one to channel two cross-over frequency must be less than the channel two to channel three cross-over frequency which must be less than the channel three to channel four cross-over frequency. Another constraint requires that the cross-over frequencies be separated by some finite amount or range. For graphical interface 200 of FIG. 2, the minimum separation between the cross-over frequencies is set at 250 Hz.

The graphical interface conveys the information regarding the cross-over frequencies and the minimum separation between them. Each slider is centered on a common path 240 (or bar), which is shown as a scaled straight line. Further, the center of the slider represents the cross-over frequency for the parameter represented by the given slider and is located on the common path 240 at a point representing the value of the cross-over frequency. When the minimum separation between each pair of cross-over frequencies is the same for all adjacent pairs, the horizontal width of the slider represents the minimum separation between cross-over frequencies and the value for each cross-over frequency is at the center of each slider. The distance between the boundaries of a slider along horizontal common path 240 is 250 Hz with one boundary 125 Hz to the right of the cross-over frequency and the other boundary of the slider 125 Hz to the left of the cross-over frequency. With boundary 214 of slider 210 touching boundary 222 of slider 220, the channel one to channel two cross-over frequency is 250 Hz less than the channel two to channel three cross-over frequency.

Alternately, the slider can be asymmetrical with a wider frequency spacing to one side than the other side. Furthermore, moving the slider to a different center frequency can also change the width, according to the center frequency to which the slider is moved. For example, a slider with center frequency of 250 Hz and a width of 200 Hz can be moved to 500 Hz with an automatic change in slider width from 200 Hz to 400 Hz, according to a predetermined rule or relationship for the given parameter.

A user of a system such as system 100 can control the fitting of the cross-over frequencies of a four channel hearing device 180 by moving sliders 210, 220, 230 in a "drag and drop" manner with pointer 160 by controlling a selection device, such as controlling the motion of mouse 130. To adjust slider 210 to a higher frequency, the pointer selects slider 210 and moves the slider to the desired frequency. With the channel two to channel three cross-over frequency set at 1650 with the minimum separation set at 250 Hz, slider 210 is constrained in its motion along common path 240 to a maximum cross-over frequency of 1400 Hz. This is conveyed to the user by limiting the motion of slider 210 to the point where boundary 214 of slider 210 touches boundary 222 of slider 220. Thus, graphical interface 200 conveys to the user that the channel one to channel two cross-over frequency can not be adjusted higher without raising the channel two to channel three cross-over frequency.

Likewise, the user can select slider 220 and move it to the right on common path 240 to higher frequencies using pointer 160 up to a limit fixed by the position of slider 230. This limit is 2,750 Hz with the center of slider 230, representing the cross-over frequency associated with slider 230, set at 3,000 Hz. However, with the channel two to channel three cross-over frequency having a range from 750 Hz to 2,500 Hz, slider 220 is limited to having its center at 2,500 Hz. The inability to move slider 220 to higher frequencies beyond 2,500 Hz indicates to the user that the channel two to channel three cross-over frequency is at its maximum frequency for fitting of hearing device 180.

In a similar fashion, the constraints for lowering the cross-over frequencies are displayed to the user as the user adjusts the cross-over frequencies to lower frequencies by moving the sliders to the left. Other embodiments are realized for hearing devices having a plurality of channels represented by a plurality of sliders representing cross-over frequencies, where the number of sliders is one less than the number of channels. In another embodiment, each cross-over frequency associated with the hearing device 180 has some allocated frequency range where the lowest or minimum cross-over frequency associated with hearing device 180 is 250 Hz and the highest or maximum cross-over frequency is 4 kHz.

Additionally, sliders can be used to represent frequency bands, rather than channels. The operation of these sliders can conducted in a manner similar to the operation of sliders for the various channels discussed above.

Figure 3:
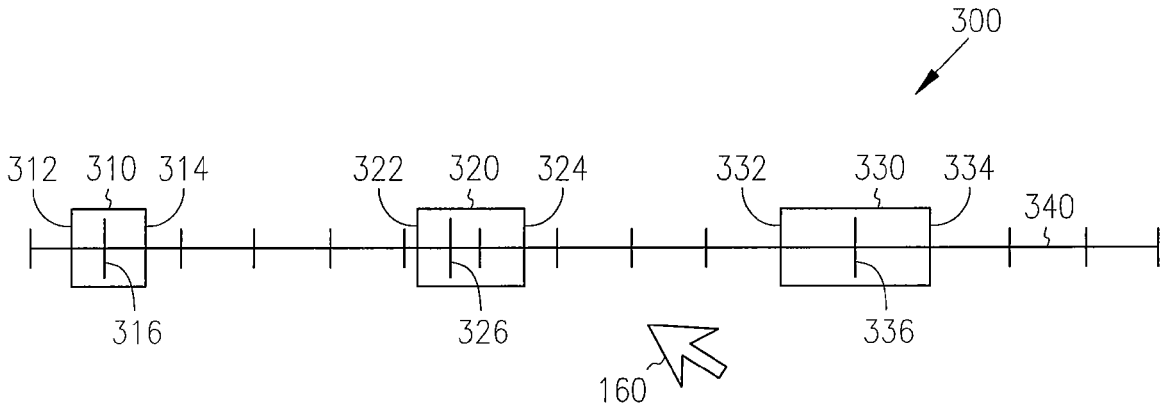
FIG. 3 shows an embodiment of elements of a graphical interface displaying a minimum separation between sliders arranged on a pair-wise basis, in accordance with the teachings of the present invention.

FIG. 3 shows an embodiment of elements of a graphical interface 300 with a minimum separation between sliders arranged on a pair-wise basis, in accordance with the teachings of the present invention. Graphical interface 300 and the operation of its sliders is similar to graphical interface 200 of FIG. 2 and its sliders. In an embodiment of graphical interface 300 to fit hearing device 180 of FIG. 1 configured as a four channel system, the minimum separation between the channel one to channel two cross-over frequency and the channel two to channel three cross-over frequency is 250 Hz, while the minimum separation between the channel two to channel three cross-over frequency and the channel three to channel four cross-over frequency is 500 Hz. This multiple minimum separation is conveyed to a user on graphical interface 300 with the boundaries 312, 314 of slider 310 separated in a horizontal distance scaled to 250 Hz, and with the boundaries 322, 324 of slider 320 separated in a horizontal distance scaled to 375 Hz. Due to the variations in minimum separation between cross-frequencies, the cross-over frequency associated with a given slider may not be centered within the slider.

The cross-over frequency in each slider is represented by a point, star, line, or other symbol within the slider. A vertical line centered on common path 340 extending vertically to points less than or equal to the top and bottom boundaries of slider 310 is used as the cross-over frequency indicator 316 for slider 310. Boundary 314 is located 125 Hz to the right of cross-over frequency indicator 316 and boundary 312 is located 125 Hz to the left of cross-over frequency indicator 316. For slider 320, boundary 324 is located 250 Hz to the right of cross-over frequency indicator 326 and boundary 322 is located 125 Hz to the left of cross-over frequency indicator 326. For slider 330, boundary 334 is located 250 Hz to the right of cross-over frequency indicator 336 and boundary 332 is located 250 Hz to the left of cross-over frequency indicator 336. Sliders 310 and 330 have cross-over frequencies centered within the slider, since there is no requirement on these sliders to have different minimum separations to the left (at lower frequencies) and to the right (at higher frequencies). Cross-over frequency indicator 326 not centered in slider 320, but shifted to the left of center, is an indication to the user that the minimum separation at the higher frequencies is greater than the minimum separation at lower frequencies. For a graphical interface using color displays, the cross-over frequency indicator within a slider can also be presented with a different color than the boundaries of the slider or the scaled common path 340.

Pointer 160 is used to select and move any one of the sliders 310, 320, 330 along the common path 340 in response to a user controlling mouse 130 in a "drop and drag" manner. The sliders 310, 320, 330 are limited in motion by the boundaries of the other sliders. For example, slider 320 can only move to higher frequencies to the right along common path 340 until boundary 324 of slider 320 touches boundary 332 of slider 330 which indicates that the channel two to channel three cross-over frequency is at 500 Hz from the channel three to channel four cross-over frequency. Slider 320 will be limited (or stopped) prior to the touching of boundaries 324 and 332 if the upper limit on the frequency range associated with slider 320 is reached by the cross-over frequency associated with slider 320 prior to the boundaries 324 and 332 touching.

In similar fashion, slider 320 can only move to lower frequencies to the left along common path 340 until boundary 322 of slider 320 touches boundary 314 of slider 310 which indicates that the channel two to channel three cross-over frequency is 250 Hz from the channel one to channel two cross-over frequency. Slider 320 will be limited (or stopped) prior to the touching of boundaries 322 and 314 if the lower limit on the frequency range associated with slider 320 is reached by the cross-over frequency associated with slider 320 prior to the boundaries 324 and 332 touching.

The limits or constraints used in graphical interfaces 200, 300 are controlled by the system providing the display of these graphical interfaces. In one embodiment system 100 of FIG. 1 provides a series of graphical interfaces in response to an application program. In one embodiment, the limits or constraints are stored as integral parts of the underlying program for the graphical interface. Alternately, the limits or constraints are stored in memory as parameters that can be changed. Thus, the various values for the limits or constraints are programmably stored in computer 110. In one embodiment, the cross-over frequencies, the frequency ranges of the cross-over frequencies, and the minimum separations between cross-over frequencies for a hearing device 180 are programmably stored in computer 110. In another embodiment, the cross-over frequencies, the frequency ranges of the cross-over frequencies, and the minimum separations between cross-over frequencies for a series of different type hearing devices are programmably stored in computer 110.

These limits or constraints are input to computer 110 as part of the instructions of a program controlling the graphical interface being used in connection with the fitting of a hearing device. This program comprises computer-executable instructions within a computer-readable medium. The computer-readable medium comprises computer memory that includes, but is not limited to, floppy disks, diskettes, hard disks, CD-ROMS, flash ROMS, nonvolatile ROM, and RAM. In one embodiment, the limits or constraints such as the cross-over frequencies, the frequency ranges of the cross-over frequencies, and the minimum separations between cross-over frequencies are provided as default values within the program that can be changed by an authorized user. In such cases, the authorized user acts as an administrator for the system 100. The administrator can input the constraints into computer 110 using the keyboard 120, a wireless interface, or a wired interface defined by a standard type of interface such as, but not limited to, PCMCIA, USB, RS-232, SCSI, or IEEE 1394 (Firewire).

In one embodiment, the limits or constraints are effectively set by a authorized user, such as an administrator, using the graphical interfaces provided by the application program. An authorized user provides the necessary password, code, or initialization procedure that indicates that the user is authorized to make changes or provide the initial values for the limits or constraints. The authorization procedure allows the authorized user to set limits and constraints within a graphical interface using pointer 160. For instance, in a cross-over frequency setting mode for graphical interface 200 fo FIG. 2, an authorized user selects the center of a slider and moves the center of the slider in a "drag and drop" manner to a location along the common path 240 whose value equals the desired value for the cross-over frequency associated with the slider. Further, in a minimum separation mode, pointer 160 is used to define the cross-over frequency and set the high frequency minimum separation and the low frequency minimum separation. For example, pointer 160 is used as mentioned above to select the cross-over frequency of slider 220. Then, the high frequency boundary 224 is selected and moved to the right along common path 240 to a point 250 Hz from the cross-over frequency. The low frequency boundary 222 of slider 220 is selected and moved to the left along the common path 240 to a point 125 Hz from the cross-over frequency. The 125 Hz distance from the cross-over frequency to boundary 222 of slider 220 sets a low frequency minimum separation of 250 Hz, while the 250 Hz distance from the cross-over frequency to boundary 224 of slider 220 sets a high frequency minimum separation of 500 Hz. Since the high frequency and low frequency minimum separation are not equal, a cross-over frequency indicator is generated at the cross-over frequency associated with slider 220. In this manner, slider 220 of FIG. 2 can be changed to slider 320 of FIG. 3 by an authorised user. In a similar manner, the frequency ranges for each cross-over frequency can be set using the graphical interfaces, as can be understood by those skilled in the art. Additionally, the above discussion not only applies to cross-over frequencies, but can be applied to any inter-related parameters.

Figure 4:
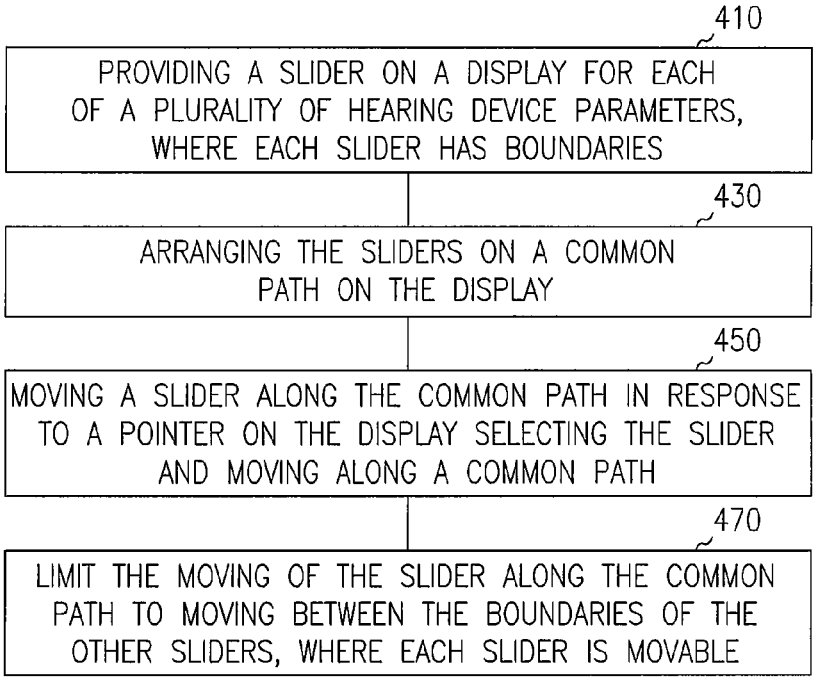
FIG. 4 shows a flow diagram of a method to select parameters for fitting hearing devices using a programmable interface, in accordance with an embodiment of the teachings of the present invention.

The program comprising computer-executable instructions for generating and using graphical interface 200 provides the instructions for computer 110 to display the graphical interface on monitor display 170 and use pointer 160 in a "drag and drop" manner in response to control of mouse 130. FIG. 4 shows a flow diagram of a method to select parameters for fitting hearing devices using a programmable interface, in accordance with an embodiment of the teachings of the present invention. The method includes providing a slider on a display for each of a plurality of hearing device parameters, where each slider has boundaries (block 410), arranging the sliders on a common path on the display (block 430), moving a slider along the common path in response to a pointer on the display selecting the slider and moving along the common path (block 450), and limiting the moving of the slider along the common path to moving between the boundaries of the other sliders, where each slider is movable (block 470).

In an embodiment, values for the hearing device parameters are programmably stored in a memory. In another embodiment, the common path has an upper limit and a lower limit defining a maximum and a minimum for the plurality of parameters, such that only one parameter can reach the minimum and only one other parameter can reach the maximum. As can be appreciated by those skilled in the art, other parameters and information related to hearing device 180 can be displayed on the screen display 160 representing the graphical interface during the fitting of hearing device 180.

Figure 5:
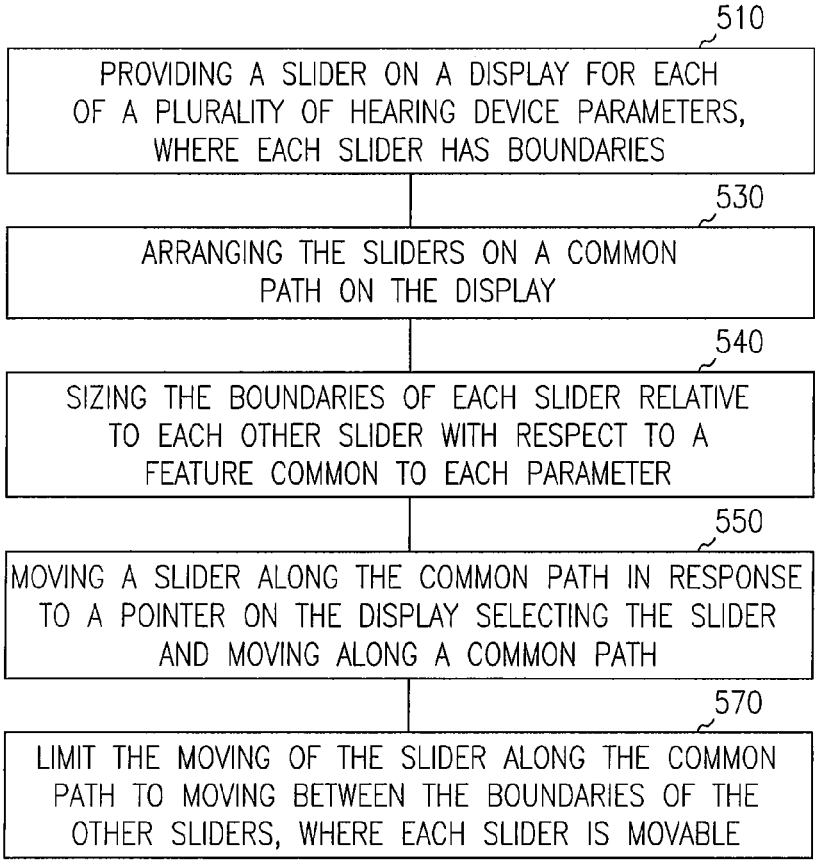
FIG. 5 shows a flow diagram of a method to select parameters for fitting hearing devices using a programmable interface, in accordance with another embodiment of the teachings of the present invention.

FIG. 5 shows a flow diagram of a method to select parameters for fitting hearing devices using a programmable interface 300, in accordance with another embodiment of the teachings of the present invention. The method includes providing a slider on a display for each of a plurality of hearing device parameters, where each slider has boundaries (block 510), arranging the sliders on a common path on the display (block 530), sizing the boundaries of each slider relative to each other slider with respect to features common to each parameter (block 540), moving a slider along the common path in response to a pointer on the display selecting the slider and moving along the common path (block 550), and limiting the moving of the slider along the common path to moving between the boundaries of the other sliders; where each slider is movable (block 570). In an embodiment, sizing each slider includes generating each slider with boundaries that are correlated to upper and lower limits of the feature of the parameter. In another embodiment, the upper or lower limits of each slider can be changed independently by the pointer selecting a boundary corresponding to the upper or lower limit and moving the selected boundary along the common path in response and correlated to the pointer moving along the common path. Concurrently, the value of the parameter represented by the slider is maintained. In yet another embodiment, each slider is generated with boundaries that are correlated to a minimum separation between parameter values represented by the sliders on a pair-wise basis between parameters.

Additionally, the values for inter-related parameters can be changed using a response curve for the inter-related parameters. For instance, clicking on a box located on a gain curve for low inputs and moving the box along a vertical path, either increasing or decreasing the gain, changes the inter-related gain for high inputs defined by a given constraint in a manner similar to moving corresponding sliders along a common path or scale. In the instance of the response curve, the common path is a vertical path representing increasing and decreasing parameter values, which in this case is gain.

With the parameters selected for fitting a hearing device as discussed above, the parameters are output to hearing device 180 via medium 190. With respect to graphical interfaces 200 and 300, the information sent to hearing device 180 includes information related to the set of cross-over frequencies associated with the four channels of hearing device 180. In an application interface using graphical interfaces such as graphical interfaces 200 and 300, numerous parameters can be displayed to a user, changed by the user, and output to a hearing device.

A Second Graphical Interface

Figure 6C:
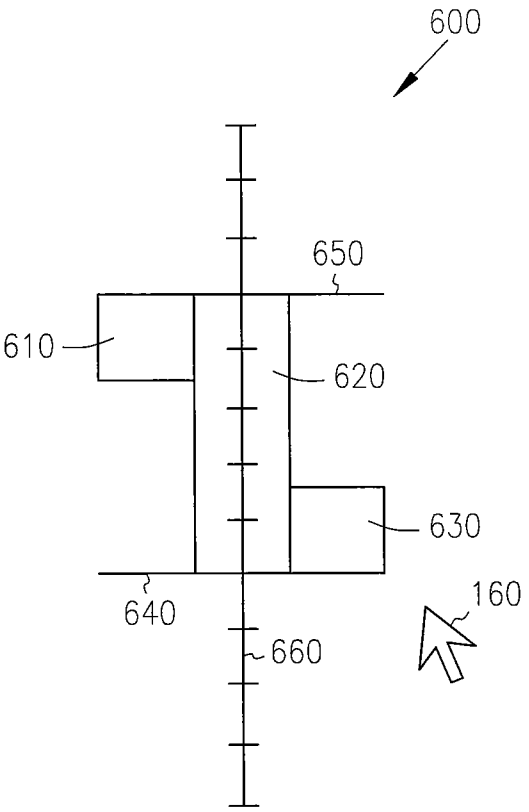
FIG. 6C shows an embodiment of elements of a graphical interface in which the two sliders of FIG. 6B have been lowered, while maintaining their difference constant, in accordance with the teachings of the present invention.
Figure 6B:
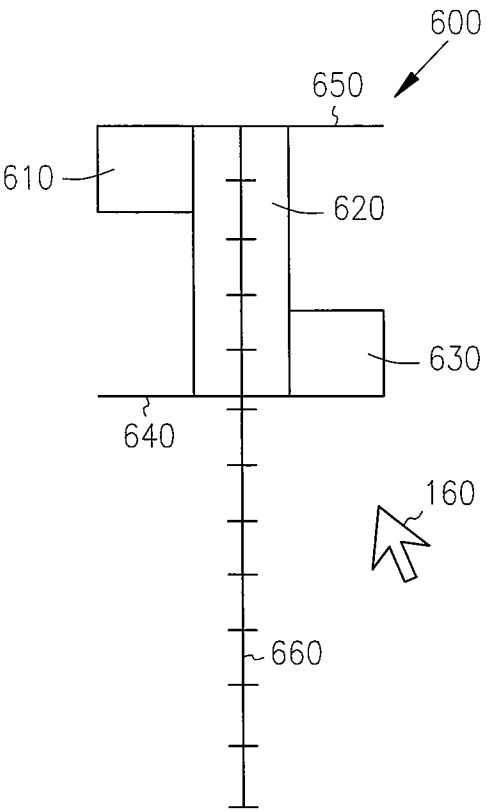
FIG. 6B shows an embodiment of elements of a graphical interface of FIG. 6A after moving a slider, in accordance with the teachings of the present invention.
Figure 6A:
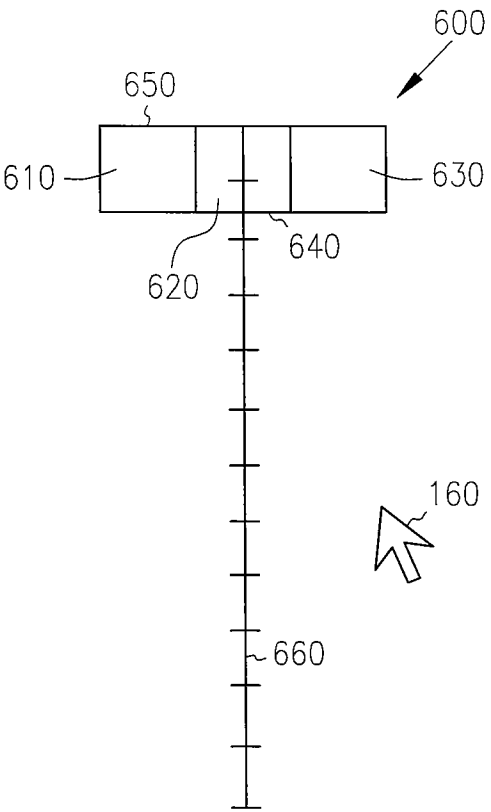
FIG. 6A shows another embodiment of elements of a graphical interface for multiple parameters, in accordance with the teachings of the present invention.

FIG. 6A shows an embodiment of elements of a graphical display 600 for multiple parameters, in accordance with the teachings of the present invention. Graphical display 600 includes a slider 610, a slider 620, a slider 630, a lower limit stop bar 640, and an upper limit stop bar 650. Slider 610 represents a parameter of a system having a value equal to a value on a scaled common path 660. The vertical dimension of slider 610 representing a value of a parameter is centered on the corresponding value of scaled common path 660. Likewise, slider 630 represents another parameter of a system having a value equal to a value on a scale of common path 660. The vertical dimension of slider 630 representing a value of the other parameter is centered on the corresponding value of the scaled common path 660. In between slider 610 and 630 is slider 620, which provides an indication of the difference between slider 610 and slider 630. The horizontal widths of sliders 610, 620, and 630 of FIG. 6A are equal. In other embodiments, the relative widths can be varied.

The difference slider 620 is centered on and constrained to move along the common path 660. Likewise, the sliders 610, 630 are constrained to move along (parallel to) the common path 660. Upper limit stop bar 650 limits the center of either slider 610 or 630 to a largest value, while lower limit stop bar 640 limits the center of slider 610 or 630 to a smallest value. Though the parameters represented by sliders 610 and 630 are different, these parameters are related to each other by a constraint or limit on the difference between their values.

On viewing graphical interface 600, a user of system 100 of FIG. 1 is informed that the parameters defined by slider 610 and slider 630 are equal as shown in FIG. 6A. Using pointer 160, a user can adjust the values associated with sliders 610 and 630 in several ways. Using pointer 160, a user selects slider 630 and moves the slider down along common path 660 to lower the value of the parameter associated with slider 630. As the slider is lowered, so also is lower limit stop bar 640 lowered. Having lowered only slider 630, the value of the parameter associated with slider 610 is greater than the value associated with slider 630. This difference is indicated to the user by slider 620, which has been elongated. The top boundary of slider 620 at the upper end of the common path remains in line with the top boundary of slider 610 at the upper end of the common path. The bottom boundary of slider 620 at the lower end of the common path moves with and remains in line with the bottom boundary of slider 630. Thus, as the slider 630 is lowered, the difference between the values associated with sliders 610 and 630 increases and the length along the common path of slider 620 increases, while the length of sliders 610, 630 remains constant. FIG. 6B shows an embodiment of elements of a graphical interface 600 of FIG. 6A after moving slider 630, in accordance with the teachings of the present invention.

Stop bars 640, 650 provide more than visual information on the differences between the parameters associated with slider 610 and slider 630. Stop bars 640, 650 show a limit or stop preventing the difference between the values associated with sliders 610, 630 from becoming larger than a predetermined limit. The predetermined limit is set in the program controlling graphical interface 600 and is programmably stored in memory of a system executing the program. Slider 630 can only be lowered to the predetermined difference limit, where on graphical interface 600 moving pointer 160 to lower values along common path 660 will not be accompanied with movement of slider 630 or lower limit stop bar 640.

FIG. 6C shows an embodiment of elements of a graphical interface 600 in which the two sliders 610, 630 of FIG. 6B have been lowered, while maintaining their difference constant, in accordance with the teachings of the present invention. This lowering of the values associated with sliders 610, 630 can be accomplished by lowering slider 630 to the desired parameter value, followed by lowering slider 610 to a point along the common path that has a value equal to the value associated with slider 630 plus the desired value of the difference between the values associated with sliders 610, 630. However, this process is not required. The separation between slider 610 and slider 630 is achieved by moving slider 630 to any value up to the limit imposed by the maximum size of slider 620. Alternately, given the display of FIG. 6B, lowering the values of the parameters associated with sliders 610, 630 can be accomplished by selecting the difference slider 620 with pointer 160 and moving the difference slider 620 along the common path to a point where the boundary of the difference slider 620 associated with the lower value reaches the desired lower boundary of slider 630. Since the lower stop bar 640 moves with a lowering in value of a slider, the difference slider 620 can be moved to a point where the lower limit stop bar 640 of FIG. 6B equals the location of the lower limit stop bar 640 of FIG. 6C.

Sliders 610, 630, difference slider 620, and stop bars 640, 650 operate in a similar manner when raising the value of a parameter associated with either slider 610 or slider 630, where the limit constraints on increasing the values is represented by upper limit stop bar 650. The parameters associated with sliders 610, 630 can be any system parameters for which there is a limit on the difference in value of the two parameters. In another embodiment, graphical interface 600 has a plurality of sliders, each slider associated with a system parameter in which all such system parameters are constrained by a relationship between each other, where the relationship has predetermined limits. In yet another embodiment, the predetermined limit in system parameters is set on a pair-wise basis.

In an embodiment of graphical interface 600 to select parameters for fitting hearing device 180 of FIG. 1, slider 610 is associated with the gain of a channel for low-level inputs and slider 630 is associated with the gain of a channel for high-level inputs. Graphical interface 600 includes one or more elements configured as in FIG. 6 A-C. A traditional graphical interface would display the channel gain for low inputs and the channel gain for high inputs on two scales with no fixed correlation between the two scales. Advantageously, the embodiment of graphical interface 600 provides for economic use of a single scale (or common path) in which the two gain parameters are correlated and limited by a constraint.

Associated with sliders 610, 630 is a constraint for fitting hearing device 180. In one embodiment, the ratio of the change in input for low inputs to high inputs to the change in output for low inputs to high inputs, measured in db, is set at about 3:1 to define a constraint. This ratio is commonly referred to as the compression ratio for output/input relation of a hearing device, which can also be written as 3.0. Alternately, the constraint for a compression ratio can be set at other values appropriate for the hearing device being programmed.

Refer to FIGS. 6A-C with slider 610 representing channel gain for low input and slider 630 representing channel gain for high input for the same channel to discuss this embodiment. FIG. 6A shows a user that the compression ratio is one. The user of graphical interface 600 can change the compression for fitting hearing device 180 as discussed above. Lowering the channel gain for high input results in a display as shown in FIG. 6B. If the user attempts to increase the difference between the gain for low input and the gain for high input by further moving slider 630 using pointer 160, the user will be limited to a difference corresponding to a compression ratio of 3:1. This limit will be demonstrated to the user by the inability to move slider 630 and consequently lower limit stop bar 640 to lower values. As mentioned above, upper limit stop bar 650 will also move as either slider 610 or slider 630 moves to higher values until the compression ratio 3:1 is reached at which time upper limit stop bar 650 becomes fixed.

The user of graphical interface 600 can also maintain a fixed compression ratio while increasing or decreasing the channel gain for both the low input and high input by using pointer 160 to move slider 620. In this manner, the user can move the values for the channel gain for low inputs and high inputs from the levels represented in FIG. 6B to the levels represented in FIG. 6C.

The user can also change the values of common path 660 by moving slider 620 along the common path 660 such that as the slider 620 moves to higher values above the display limit for the common path, the values associated with the sliders and common path 660 increase according to the scale of the common path 660. Likewise lowering slider 620 below the lowest end of common path 660 lowers the values associated with the sliders and common path 660 according to the scale of the common path 660. In one embodiment, common path 660 is a scaled axis or scaled line according to the dimensions of the parameter being displayed. In another embodiment, common path 660 is a scaled curvilinear path.

Other pairs of parameters for fitting hearing device can be set using an embodiment of graphical interface 600. In one embodiment of graphical interface 600, slider 610 represents values for maximum power output (MPO) of hearing device 180 of FIG. 1 and slider 630 represents the peak gain or maximum gain associated with hearing device 180. The peak gain or maximum gain may be either an actual peak or a high frequency average gain. The configuration of these parameters along one common path allows selection of these parameters in a system that allows setting of these parameters constrained by limits for fitting hearing device 180. As with the channel gain for low inputs and high inputs, the limits or constraints associated with fitting the hearing device are maintained in the program controlling graphical interface 600. These limits or constraints can be stored and changed in memory in a system, such as system 100 of FIG. 1, running the program for fitting a hearing device. In a manner corresponding to that for graphical interface 200 of FIG. 2, the limits and constraints can be changed in the program via the keyboard 120, a wireless interface, or a wired interface defined by a standard type of interface such as, but not limited to, PCMCIA, USB, RS-232, SCSI, or IEEE 1394 (Firewire), or using graphical interface 600.

Having selected parameters using graphical interface 600, the parameters are output to hearing device 180 via medium 190 of FIG. 1. The program or computer-executable instructions to select the parameters and output the parameters can be stored in any computer-readable medium, which includes, but is not limited to, floppy disks, diskettes, hard disks, CD-ROMS, flash ROMS, nonvolatile ROM, and RAM.

Figure 7:
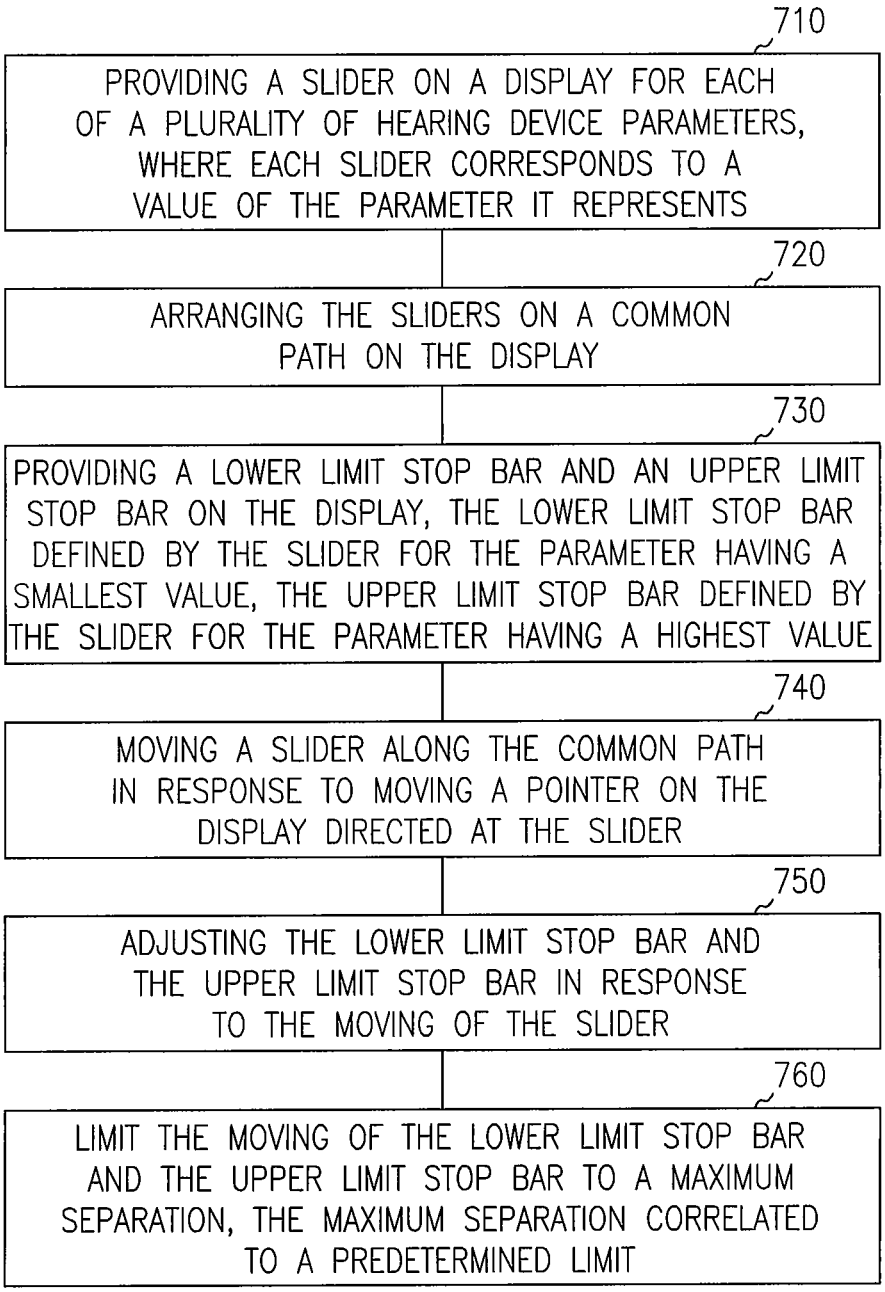
FIG. 7 shows a flow diagram of a method to select parameters for fitting hearing devices using a programmable interface, in accordance with an embodiment of the teachings of the present invention.

The program comprising computer-executable instructions for generating and using graphical interface 600 provides the instructions for computer 110 to display graphical interface 600 on monitor display 170 and use pointer 160 in a "drag and drop" manner in response to control of mouse 160. In addition to "drag and drop," these sliders can be moved by clicking with the cursor placed along a common path above or below the slider. FIG. 7 shows a flow diagram of a method to select parameters for fitting hearing devices using a programmable interface, in accordance with an embodiment of the teachings of the present invention. The method includes providing a slider on a display for each of a plurality of hearing device parameters, where each slider corresponds to a value of the parameter it represents (block 710), arranging the sliders along a common path on the display (block 720), providing a lower limit stop bar and an upper limit stop bar on the display, where the lower limit stop bar is defined by the slider for the parameter having a smallest value, and the upper limit stop bar is defined by the slider for the parameter having a highest value (block 730), moving a slider along the common path in response to moving a pointer on the display directed at the slider (block 740), adjusting the lower limit stop bar and upper limit stop bar in response to the moving of the slider (750), and limiting the moving of the lower limit stop bar and the upper limit stop bar to a maximum separation, the maximum separation correlated to a predetermined limit (block 760).

In one embodiment, three sliders are provided along an scaled axis providing a common path. The program provides a graphical interface which displays one slider as a center slider with the scaled axis running through the center slider and providing one slider to the right of the center slider and one slider to the left of the center slider. The method further associates a predetermined limit of separation between the two sliders on either side of the center slider correlated to a maximum value of a ratio of the value of one parameter associated with one slider to the value of another parameter associated with the other slider. Moving a slider of a parameter along the common path changes the value of the parameter to a value correlated to a position along the common path to which the slider is moved. In one embodiment, moving a difference slider representing a difference between two parameters along the common path in response to a pointer directed at the difference slider moves the sliders of the two parameters along the common path and changes the values of the two parameters to values associated with the position along the common path to which the sliders of the two parameters are moved. Further, moving a slider representing a parameter changes a value of the parameter to a value correlated to a position along the common path to which the slider of the parameter is moved.

A Third Graphical Interface

Figure 8:
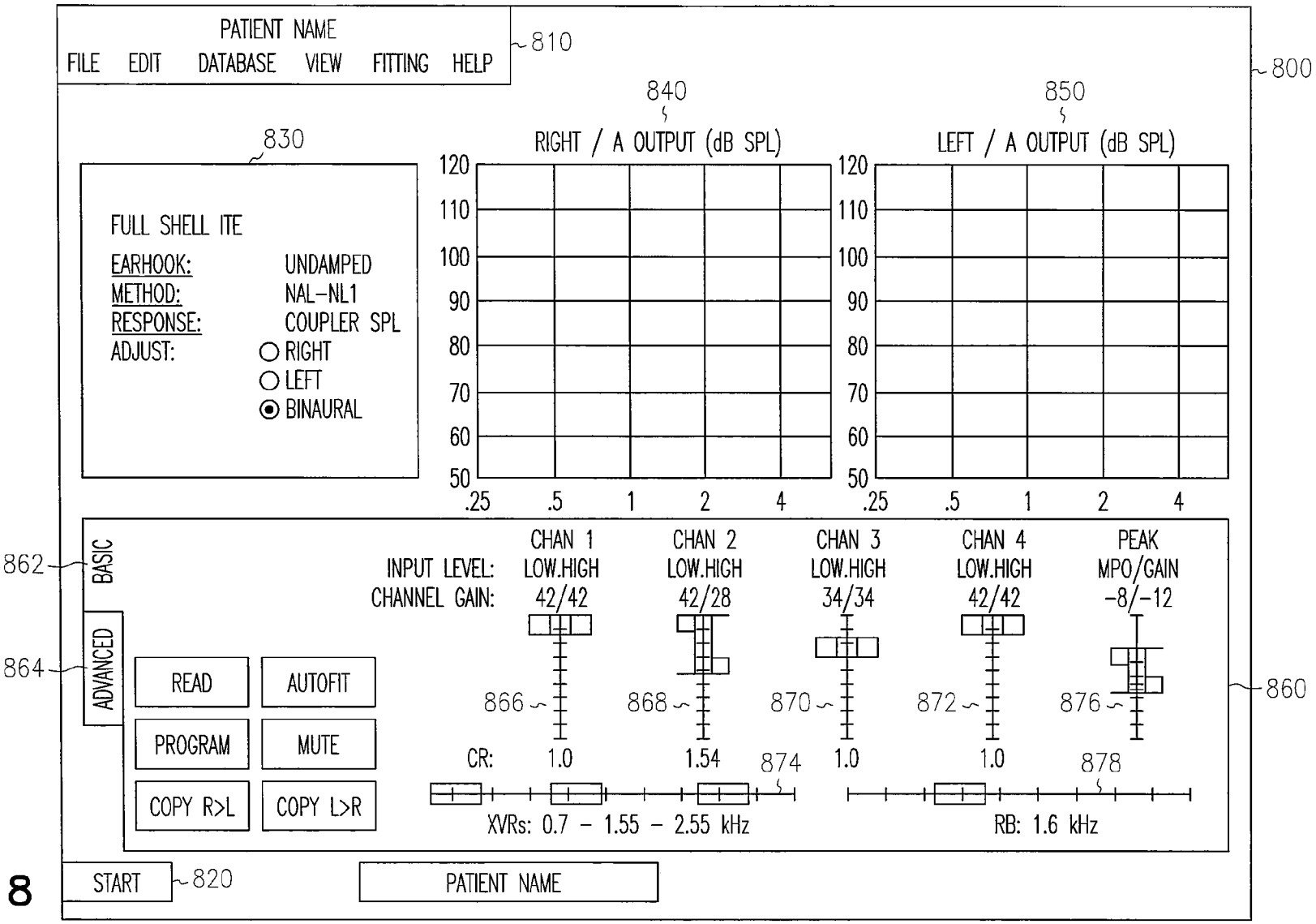
FIG. 8 shows an embodiment of a graphical interface incorporating elements of the graphical interfaces of FIG. 2 and FIG. 6 to select parameters for fitting the hearing device of FIG. 1, in accordance with the teachings of the present invention.

FIG. 8 shows an embodiment of a graphical interface 800 incorporating elements of graphical interface 200 of FIG. 2 and graphical interface 600 of FIG. 6 to select parameters for fitting hearing device 180 of FIG. 1, in accordance with the teachings of the present invention. Advantageously, providing a graphical interface with multi-function controls for parameters having a constraining relationship on single common paths using simplified controls allows for the streamlining and economizing of space on the graphical interface. This representation of parameters for fitting hearing device 180 allows for communication with the user of the graphical interface about the interactions between parameters and the limits of the parameters relative to one another.

Graphical interface 800 of FIG. 8 includes a set 810 of standard personal computer type menu "drop down" buttons to allow the user to control, edit, view, and obtain help regarding files in a conventional manner. Set 810 also includes menu "drop down" buttons for selecting a database to be accessed and for selecting program controls for fitting hearing device 180. Graphical interface 800 also has a standard start button 820 for logging off, restarting, logging on new users, and other standard tasks, as is well known. Graphical interface 800 also displays an informational section 830 for conveying information on the type of hear device 180 being fitted and associated testing information. It provides for the display of hearing device right output 840 and left output 850 in terms of dB sound pressure level (SPL). Graphical interface also provides a control section 860 for setting parameters to fit hearing device 180.

Informational section 830 indicates to a user that the hearing device is a full shell in the ear (ITE) hearing device. The ITE hearing device 180 has been tested using the National Acoustics Laboratory (NAL) method NL1 that provides a prescriptive formula for fitting hearing devices. The response was provided with a coupler SPL and that adjustment was binaural. Informational section 830 also provides the ability to select adjustment as either right, left, or binaural. The informational section 830 is not limited to displaying the information shown in FIG. 8, but can provide information on related parameters as are known to those skilled in the art.

Control section 860 has two displays. One display is to view and set basic parameters for fitting hearing device 180. A second display allows the viewing and modifying of advanced parameters for fitting hearing device 180. Graphical interface 800 provides for selecting the basic display or the advanced display by using pointer 160 to select Basic tab 862 or Advanced tab 862. Sections of the Basic tab 862 are discussed below. Sections for Advanced tab 864 include additional parameter settings for fitting hearing device 180. However, adjusting parameter settings of parameters on the Advanced tab 864 is similar to adjusting settings for the Basic tab 862 and will not be discussed further.

Control section 860 for Basic tab 862 displays for four channel gain controls 866, 868, 870, 872; a cross-over frequencies control 874, a peak output control 876, a resonance booster control 878, and a set of select buttons for read, autofit, program, mute, copy right to left, and copy left to right. With the seven controls for gain, cross-over frequency, peak gain, and resonance booster, information is provided to a user concerning fourteen separate parameters. Advantageously, a user of graphical interface 800 is able to control fourteen parameters with seven monitors aided by the system running graphical interface 800 maintaining required constraints on these parameters.

Channel gain control 866 for channel one indicates that the channel gain for both low input and high input is 42 dB, providing a compression ratio (CR) of 1.0. The value for the compression ratio is displayed below the channel gain control 866. Channel gain control 868 for channel two indicates that the channel gain for low input is 42 dB and for high input is 28 dB, providing a compression ratio of 1.54. The value for the compression ratio is displayed below the channel gain control 868. Channel gain control 870 for channel three indicates that the channel gain for both low input and high input is 34 dB, providing a compression ratio of 1.0. The value for the compression ratio is displayed below the channel gain control 870. Channel gain control 872 for channel four indicates that the channel gain for both low input and high input is 42 dB, providing a compression ratio of 1.0. The value for the compression ratio is displayed below the channel gain control 872. The parameters for each channel gain control 866, 868, 870, 872 can be set in the same manner as the sliders in graphical interface 600 of FIGS. 6A-C. Again, the programmed constraint for channel gain is a compression ratio of 3.0. Movement of any slider along an axis (common path) in any channel gain control 866, 868, 870, 872 that attempts to exceed a compression ratio of 3.0 will result in fixing the stop bars at the 3.0 compression ratio. In one embodiment, the displays will undergo a color change if an attempt is made to surpass the compression ratio constraint. The compression ratio constraint is programmable and can be set to other values such as 1.5, 2.0, 4.0, or other values between these values.

For the four channels, there are three cross-over frequencies: cross-over frequency from channel one to channel two, cross-over frequency from channel two to channel three, and cross-over frequency from channel three to channel four. Cross-over frequencies control 874 conveys that the three cross-over frequencies (XVRs) are at 0.7 kHz, 1.55 kHz, and 2.55 kHz as displayed below cross-over frequencies control 874 and also indicated on the scaled axis along which sliders representing the cross-over frequencies can be moved. With the scale of 0.250 kHz, the cross-over frequencies control 874 indicates a minimum separation between cross-over frequencies of about 250 Hz. The cross-over frequencies can be set in the same manner as discussed for graphical interfaces 200, 300 of FIGS. 2, 3, respectively. The underlying program for graphical interface 800 has values set for limits on the possible frequency ranges for each cross-over frequency, the minimum separation between cross-over frequencies, and the allowable frequency range for the set of three cross-frequencies.

Peak output control 876 indicates that the maximum power output (MPO) for hearing device 180 is set at −18 dB with the peak gain currently at −12 dB. These two peak gain parameters are adjustable in a manner as discussed for graphical interface 600 of FIG. 6. The constraint relating the peak gain to the maximum power output is maintained within the system, such as system 100 of FIG. 1, having been initially provided to system 100 via the program running the graphical interfaces to fit hearing device 180. These constraints are programmable.

Resonance booster control 878 indicates that the peak of the frequency response curve of hearing device 180 is currently set at 1.6 kHz. This resonance booster frequency is displayed below the resonance booster control 878. The slider for resonance booster control 878 can be sized and moved in a manner in accordance with the sliders of graphical interface 300 of FIG. 3. The constraints for the values of the peak of the frequency response curve and the width of the slider is programmably maintained within the program and system running the program for selecting the parameters to fit hearing device 180 using graphical interface 800.

Upon setting the parameters such as the channel gains, cross-over frequencies, maximum power output, peak gain, resonance booster frequency, and other adjustable parameters for fitting hearing device 180, the program for running graphical interface 800 provides instructions for system 100 to generate the appropriate signals to hearing device 180 from computer 110 via medium 190.

A Graphical Interface Using Three-Dimensional Representation

Figure 9:
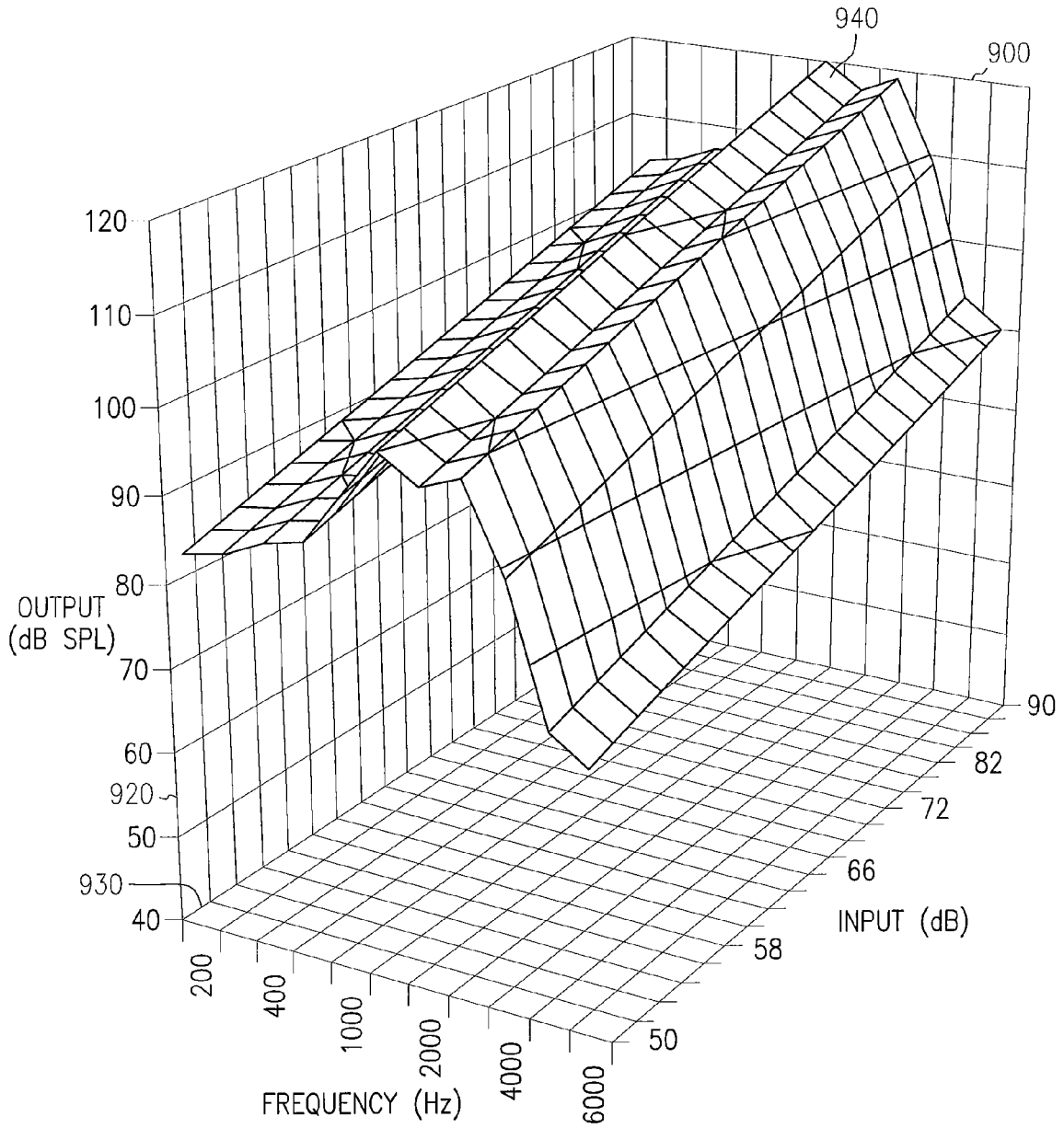
FIG. 9 shows an embodiment of elements of a graphical interface displaying a three-dimensional representation of a response of a hearing device, in accordance with the teachings of the present invention.

FIG. 9 shows an embodiment of elements of a graphical interface displaying a three-dimensional representation 900 of a response of a hearing device, in accordance with the teachings of the present invention. Typically, in conventional systems for fitting hearing devices, output related parameters, such as gain or output in SPL, as a function of frequency is displayed on a system monitor and used to fit a hearing device. Another factor that should be considered is the output or gain as a function of the input.

In one embodiment, a three-dimensional representation 900 of a hearing device response is used to generate a programmable auditory space for fitting the hearing device. The three-dimensional representation 900 includes a frequency axis 910 in Hz, an output axis 920 in dB SPL, and an input axis 930 in dB SPL. The three-dimensional representation 900 is linked back to graphical interface 800 of FIG. 8 such that any changes in the sliders controlling parameters affecting the frequency, the output, and the input generate changes in the three-dimensional curve 940 of the three-dimensional representation 900. Likewise, moving portions of the three-dimensional curve 940 changes the values of a set of parameters, which is reflected in the corresponding motion of their representative sliders to new values. In another embodiment, the output axis is gain in dB.

In one embodiment, a target curve is generated on the three-dimensional representation 900. Target curves are generated from an audiogram, and other sources, using a testing method such as NAL-NL1 providing a target frequency response for low inputs and a target frequency response for high inputs. These are combined and displayed as a three dimensional curve on the three-dimensional representation 900 along with three-dimensional curve 940. Using a pointer 160 of system 100 of FIG. 1, portions of the three-dimensional curve 940 are moved to match the target three-dimensional representation with the movement of the curve providing difference measurements that can be used to determine adjustments for fitting hearing device 180.

In one embodiment, to change a crossover frequency, pointer 160 selects the frequency axis, which becomes highlighted. As a result of selecting the frequency axis, lines appear across the frequency axis that can be moved back and forth to change the shape of the auditory space. Further, selecting the input axis, instead of the frequency axis, allows adjustment of the compression threshold along the input axis. Changing the compression threshold along the input axis also changes the three-dimensional auditory space. Still further, selecting the output axis allows changes to the overall gain by selecting and adjusting output levels along the output axis using pointer 160.

Upon adjusting three-dimensional curve 940 on the three-dimensional representation 900, the adjustments are correlated to required changes in the parameters for fitting hearing device 180. These new parameters are determined, and corresponding signals are output from computer 110 to hearing device 180 via medium 190 to make the required adjustments for fitting hearing 180.

Conclusion

A graphical interface is provided to select parameters for fitting a hearing device. The graphical interface provides means visually representing and controlling values of these parameters using a common reference for multiple parameters related by a programmable constraint. These common reference structures provide a compact streamlined graphic tool for adjusting a programmable hearing device. Further, the common reference multiple parameter structures provide clarity and ease of use. They allow simple controls for multiple functions.

Additionally, the common reference multiple parameter structures convey information to a user about the interactions among parameters and the limits of the parameters. These interactions and limits are related to constraints on the parameters related to the hearing device that is being programmed.

Such relationships can include parameters on different aspects for programming a hearing device as long as the relationships are defined by constraints or limits. In addition to the graphical interface providing for the programming of a hearing device, the related constraints used by the graphical interface are programmable in a system running the graphical interface.

The graphical interface provides a method for fitting a hearing device including adjusting a first slider on a graphical display and adjusting a second slider on the graphical display. The first slider represents a first parameter of the hearing device, and the second slider represents a second parameter of the hearing device. The first slider and the second slider are adjustable in a range limited by a predetermined constraint between settings of the first and second parameter.

The graphical interface employs a method for selecting hearing device parameters that makes use of a "drag and drop" feature of a graphical pointer or cursor arrow. By moving sliders on the graphical interface in response to moving the pointer, a user can conveniently set the required parameters. Further, parameters related by a constraint relation are displayed on graphical structures having a common path, such that movement of a slider representing a parameter can be limited by the constraints. Such limited movement is visually conveyed to the user allowing the user to make appropriate adjustment to remain within the limits of the constraint while programming a hearing device for optimum performance.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A method for fitting a hearing assistance device comprising:

receiving values for an output related parameter and associated frequencies that define the output related parameter as a function of frequency for the hearing assistance device;

receiving output values and associated input values to define output as a function of input for the hearing assistance device;

generating on a display a three-dimensional representation of the hearing assistance device in an auditory space defined by the output related parameter, the frequency, and the input;

receiving data correlated to a user of the hearing assistance device, and generating a three-dimensional target in terms of the output related parameter, the frequency, and the input;

presenting the three dimensional target on the same display as the three-dimensional representation of the hearing assistance device;

providing a plurality of movable sliders representing parameters related to the output related parameter, the associated frequencies, and the input such that changes to the three-dimensional representation are reflected in the sliders and changes to the sliders are reflected in the three-dimensional representation; and producing a set of parameters defining an auditory space of the hearing assistance device by adjustments to a three-dimensional representation of the hearing assistance device to match at least some portion of the three-dimensional target or by adjustments to the settings of the sliders and further wherein changes to the three-dimensional representation of the hearing assistance device are reflected in settings of one or more sliders and wherein changes in the settings of the sliders are reflected in the three-dimensional representation.

2. The method of claim 1, further including adjusting the three-dimensional representation of the hearing assistance device using a graphical pointer to match at least some portion of the three-dimensional target.

3. The method of claim 2, wherein adjusting the three-dimensional representation of the hearing assistance device to match at least some portion of the three-dimensional target includes using the graphical pointer to selectively move a portion of the three-dimensional representation of the hearing assistance device.

4. The method of claim 3, wherein using a pointer to selectively move a portion of the three-dimensional representation of the hearing assistance device moves sliders representing values of the output related values, the associated frequencies, and the input of the hearing assistance device.

5. The method of claim 2, wherein adjusting the three-dimensional representation of the hearing assistance device to match at least some portion of the three-dimensional target generates a set of parameters for adjusting the hearing assistance device.

6. The method of claim 5, further including outputting the set of parameters for adjusting the hearing assistance device.

7. The method of claim 2, wherein adjusting the three-dimensional representation of the hearing assistance device to match at least some portion of the three-dimensional target includes adjusting values on an axis representing the output related values, the associated frequencies, or the input values.

8. A computer-readable medium having computer-executable instructions for a graphical interface for fitting a hearing assistance device performing a method comprising:

receiving values for an output related parameter and associated frequencies that define the output related parameter as a function of frequency for the hearing assistance device;

receiving output values and associated input values to define output as a function of input for the hearing assistance device;

generating on a display a three-dimensional representation of the hearing assistance device in an auditory space defined by the output related parameter, the frequency, and the input;

receiving data correlated to a user of the hearing assistance device, and generating a three-dimensional target in terms of the output related parameter, the frequency, and the input;

presenting the three dimensional target on the same display as the three-dimensional representation of the hearing assistance device;

providing a plurality of movable sliders representing parameters related to the output related parameter, the associated frequencies, and the input such that changes to the three-dimensional representation are reflected in the sliders and changes to the sliders are reflected in the three-dimensional representation, and producing a set of parameters defining an auditory space of the hearing assistance device by adjustments to a three-dimensional representation of the hearing assistance device to match at least some portion of the three-dimensional target or by adjustments to the settings of the sliders and further wherein changes to the three-dimensional representation of the hearing assistance device are reflected in settings of one or more sliders and wherein changes in the settings of the sliders are reflected in the three-dimensional representation.

9. The computer-readable medium of claim 8, further including adjusting the three-dimensional representation of the hearing assistance device using a graphical pointer to match at least some portion of the three-dimensional target.

10. The computer-readable medium of claim 9, wherein adjusting the three-dimensional representation of the hearing assistance device to match at least some portion of the three-dimensional target generates a set of parameters for adjusting the hearing assistance device.

11. A system for fitting a hearing assistance device comprising:

a monitor for displaying a graphical interface;

a selection device for moving a graphical pointer displayed on the graphical interface; and a computer coupled to the monitor and the selection device, the computer programmed to:

receive values for an output related parameter and associated frequencies that define the output related parameter as a function of frequency for the hearing assistance device;

receive output values and associated input values to define output as a function of input for the hearing assistance device;

generate on a display a three-dimensional representation of the hearing assistance device in an auditory space defined by the output related parameter, the frequency, and the input;

receive data correlated to a user of the hearing assistance device, and generating a three-dimensional target in terms of the output related parameter, the frequency, and the input;

present the three-dimensional target on the same display as the three-dimensional representation of the hearing assistance device;

provide a plurality of movable sliders representing parameters related to the output related parameter, the associated frequencies, and the input such that changes to the three-dimensional representation are reflected in the sliders and changes to the sliders are reflected in the three-dimensional representation; and produce a set of parameters defining an auditory space of the hearing assistance device by adjustments to a three-dimensional representation of the hearing assistance device to match at least some portion of the three-dimensional target or by adjustments to the settings of the sliders and further wherein changes to the three-dimensional representation of the hearing assistance device are reflected in settings of one or more sliders and wherein changes in the settings of the sliders are reflected in the three-dimensional representation.

12. The system of claim 11, wherein the computer is further programmed to adjust the three-dimensional representation of the hearing assistance device using the graphical pointer to match at least some portion of the three-dimensional target.

13. The system of claim 12, wherein the computer programmed to adjust the three-dimensional representation of the hearing assistance device to match at least some portion of the three-dimensional target includes the computer programmed for the graphical pointer to selectively move a portion of the three-dimensional representation of the hearing assistance device.

14. The system of claim 13, wherein the computer programmed for the graphical pointer to selectively move a portion of the three-dimensional representation of the hearing assistance device includes the computer programmed to concurrently move sliders representing values of the output related values, the associated frequencies, or the input of the hearing assistance device.

15. The system of claim 14, wherein the computer programmed to adjust the three-dimensional representation of the hearing assistance device to match at least some portion of the three-dimensional target includes the computer programmed to generate a set of parameters for adjusting the hearing assistance device.

16. The system of claim 15, wherein the computer is further programmed to output the set of parameters for adjusting the hearing assistance device.

17. The system of claim 12, wherein the computer programmed to adjust the three-dimensional representation of the hearing assistance device to match at least some portion of the three-dimensional target includes the computer programmed to adjust values on an axis representing the output related values, the associated frequencies, or the input values.

18. The system of claim 11, wherein the computer is programmed to communicate wirelessly with the hearing assistance device.

19. The system of claim 18, wherein the computer is programmed to communicate wirelessly with a peripheral unit coupled to the hearing assistance device.

20. The system of claim 18, wherein the computer is programmed to communicate wirelessly with the hearing assistance device using radio frequency communications.

* * * * *